US008184962B2

(12) United States Patent
Zanolin et al.

(10) Patent No.: US 8,184,962 B2
(45) Date of Patent: May 22, 2012

(54) MOBILE DEVICE FOR HEATING ROOMS

(75) Inventors: Sergio Zanolin, Polcenigo (IT); Filippo Grandin, San Dona de Piave (IT)

(73) Assignee: De' Longhi SpA, Treviso (IT)

( * ) Notice: Subject to any disclaimer, the term of this patent is extended or adjusted under 35 U.S.C. 154(b) by 408 days.

(21) Appl. No.: 12/446,629

(22) PCT Filed: Oct. 19, 2007

(86) PCT No.: PCT/EP2007/061219

§ 371 (c)(1),
(2), (4) Date: Apr. 22, 2009

(87) PCT Pub. No.: WO2008/049791

PCT Pub. Date: May 2, 2008

(65) Prior Publication Data

US 2010/0003018 A1 Jan. 7, 2010

(30) Foreign Application Priority Data

Oct. 23, 2006 (IT) ..... UD2006A0223

(51) Int. Cl.
*F24H 3/00* (2006.01)

(52) U.S. Cl. ..... 392/373; 392/377; 392/378

(58) Field of Classification Search ..... 392/347–359, 392/373–378
See application file for complete search history.

(56) References Cited

U.S. PATENT DOCUMENTS

| | | | | | |
|---|---|---|---|---|---|
| 452,828 | A | * | 5/1891 | Bond | 165/130 |
| 4,493,974 | A | * | 1/1985 | Ganek et al. | 392/357 |
| 4,870,253 | A | * | 9/1989 | De'Longhi | 392/358 |
| 5,341,455 | A | * | 8/1994 | de'Longhi | 392/378 |
| D354,557 | S | * | 1/1995 | Cich et al. | D23/330 |
| 5,685,365 | A | * | 11/1997 | De'Longhi | 165/135 |
| 5,963,708 | A | * | 10/1999 | Wong | 392/352 |
| D423,090 | S | * | 4/2000 | Barbosa | D23/330 |
| D530,412 | S | * | 10/2006 | Aydin | D23/330 |
| D624,166 | S | * | 9/2010 | Zanolin et al. | D23/330 |
| 2002/0076213 | A1 | * | 6/2002 | Pelonis | 392/358 |

FOREIGN PATENT DOCUMENTS

| | | |
|---|---|---|
| DE | 16 79 446 | 1/1970 |
| EP | 0 723 122 | 7/1996 |
| GB | 2 323 156 | 9/1998 |
| JP | 5-291764 | 11/1993 |

* cited by examiner

*Primary Examiner* — Thor Campbell
(74) *Attorney, Agent, or Firm* — Hamre, Schumann, Mueller & Larson, P.C.

(57) ABSTRACT

A mobile device for heating rooms, comprising radiant elements, each provided with two heat-conductor plates associated with each other to define a central portion and connected fluid-dynamically with each other by means of connection elements. A heated heat-carrying fluid is able to flow in the central portions and, through the connection elements, from one to the other of the radiant elements in order to heat the surrounding room. Each pair of heat-conductor plates comprises lateral walls which are distanced from the corresponding central portion so as to define respective peripheral zones. The mobile device also comprises heat-insulating elements able to be applied due to having substantially the same shape so as to cover at least a part of the peripheral zones of the lateral walls.

14 Claims, 6 Drawing Sheets

MOBILE DEVICE FOR HEATING ROOMS

FIELD OF THE INVENTION

The present invention concerns a mobile device for heating rooms comprising one or more radiant elements, in which a heat-carrying fluid flows.

BACKGROUND OF THE INVENTION

Mobile heating devices are known, such as for example heat radiators comprising one or more radiant elements, connected to each other and hydraulically communicating, each of which is defined by two metal plates connected in sealed manner with each other so as to define a central portion more or less extended with respect to the width of the plate.

The central portions are normally connected hydraulically with each other by means of upper and lower collectors.

A diathermic oil, heated by means of one or more electric resistances, is made to flow in the central portions and, through the collectors, from one radiant element to the other.

In the field of mobile heating devices of this type, one of the problems generally faced is that of transmitting heat energy in the room so as to heat the room as rapidly as possible, or to heat large-size rooms, keeping the temperature of the peripheral zones, which can easily come into contact with a part of the body of a user, particularly children, at a lower level with respect to that of the central portions.

The purpose is to keep said temperature at a level such as not to cause the user any burns.

In known heating devices, this problem has been faced, for example, by making, directly in the peripheral zones of the plates, geometries defined by bends or fins which allow to dissipate the heat arriving from the central portion towards the room.

Although efficient and appreciated, this known solution can be improved so as to obtain a temperature level in the peripheral zones of the plate even lower with respect to that obtainable at present, given the same heat energy emitted.

DE-A1-1679446 discloses a mobile radiator in which, for aesthetic reasons, thin covering plates are mounted in front of the edge of each single module of the radiator. The covering plates are fixed to a lower and an upper mounting cross-bars, which run for the length of the radiator, and are mounted with screws and rivets at a distance from the respective module of the radiator.

The covering plates are made with a material which does not affect the heat transmission, both by contact and by radiation, from the radiator to the environment.

One purpose of the present invention is therefore to improve the techniques currently used, achieving a mobile device for heating rooms which allows to keep at a lower temperature than that which is obtainable at present at least the zones that can easily come into contact with the parts of the body of a user, while still allowing to produce the desired and efficient heating of the room.

Another purpose of the present invention is to achieve a mobile device for heating rooms which has good accident-prevention characteristics and pleasant and personizable aesthetics.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a mobile heating device according to the present invention is used for heating rooms and comprises one or more radiant elements, each consisting of two heat-conductor plates associated with each other so as to define a central portion, and fluid-dynamically connected with each other by means of connection means, for example collector, or similar elements.

The central portion can be extended to a greater or lesser degree with respect to the width of the heat-conductor plates.

A heat-carrying fluid, such as a diathermic oil, heated for example by means of one or more electric resistances, is made to flow in the central portions and, through the connection means, from one to the other of the radiant elements in order to heat the surrounding room.

Each pair of heat-conductor plates comprises lateral walls which are distanced from the corresponding central portion so as to define respective peripheral zones.

According to a characteristic of the present invention, the mobile heating device also comprises heat-insulating covering means able to be directly applied, due to having substantially the same shape, in order to cover at least a part of the peripheral zones, for example the peripheral edges, of the lateral walls, and thus prevent direct contact with the plates by the user, and in particular with said peripheral zones.

According to the present invention, the heat-insulating covering means is made in a heat-insulating material and therefore allows to keep the temperature lower in correspondence with at least with the peripheral zones, compared with known solutions, while allowing to produce the desired heating of the room.

According to a first solution, the heat-insulating means is made of elastomer material, for example rubber.

According to a variant, the heat-insulating means is made of plastic material, advantageously thermoplastic.

According to another solution, the heat-insulating means comprises covering elements having an extension that reproduces, in shape and size, substantially the perimeter profile of the peripheral zones.

Advantageously, the covering elements are shaped to be made solid with said peripheral zones by means of a male-female coupling, which does not require auxiliary attachment means.

According to a variant, an attachment means is provided to make the heat-insulating means and the peripheral zones solid.

According to an advantageous solution, the heat-insulating means can be made either as several elements disposed adjacent or close up, or as a single element, and is applied so as to cover at least the upper and lateral peripheral zones preferably at least for a quantity equal to about 60-70% of the overall height of each heat-conductor plate.

According to another advantageous solution, the heat-insulating means is applied so as to also cover the lower peripheral zones.

Advantageously, according to this solution, the heat-insulating means is shaped like a ring having a development substantially equal to or slightly less than the perimeter of the peripheral zones, so as to wind in a single element around the whole of said perimeter.

According to another solution, the heat-insulating means comprises, advantageously in a single piece, protection elements which develop along the peripheral zones and cover at least a part of the space between two adjacent peripheral zones.

According to this solution, the heat-insulating means is able to be applied to the peripheral zones so as to dispose said protection elements substantially co-planar with each other.

According to one embodiment of the invention, the protection elements of two adjacent heat-insulating means are distanced from each other to define a channel through which air is free to pass.

According to a variant, the protection elements are at least partly in contact with each other defining a substantially closed protection along at least part of the lateral and/or upper surface of the mobile heating device.

According to another solution, the protection elements are provided in correspondence with at least the upper and/or lateral peripheral surfaces of said plates.

In this way, the heat-insulating means protects from impacts against the radiant elements, guaranteeing good accident-prevention characteristics and pleasant aesthetics.

BRIEF DESCRIPTION OF THE DRAWINGS

These and other characteristics of the present invention will become apparent from the following description of some preferential forms of embodiment, given as a non-restrictive example with reference to the attached drawings wherein.

DETAILED DESCRIPTION OF SOME PREFERENTIAL FORMS OF EMBODIMENT

Figure 1:
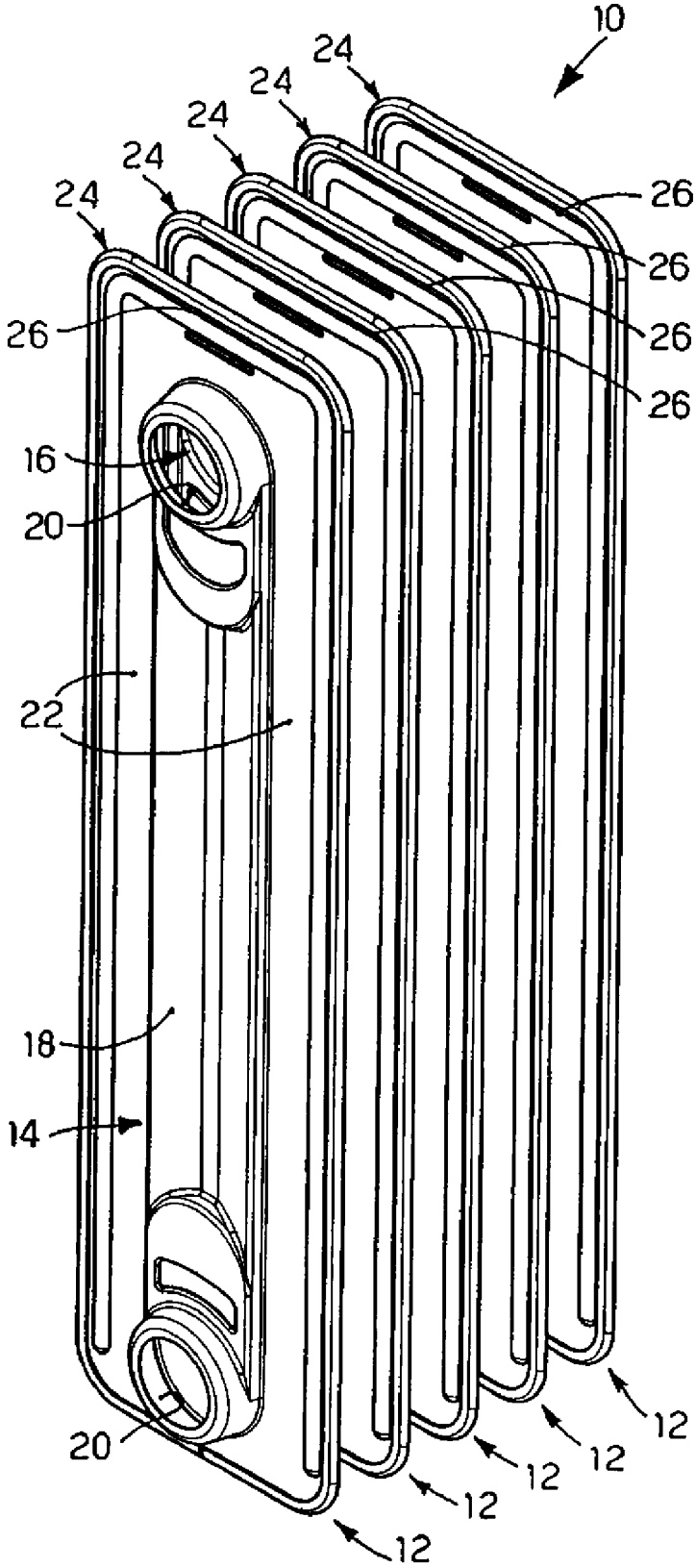
FIG. 1 is a three-dimensional view of a first form of embodiment of a mobile device for heating rooms according to the present invention.

With reference to FIG. 1, a mobile device 10 is used for heating rooms.

The mobile device 10 comprises, in this case, five radiant elements 12, each one provided with two heat-conductor plates, respectively first 14 and second 16, associated with each other, for example by welding, so as to define a central portion 18 of the corresponding radiant element 12.

It is clear however that the mobile device 10 can have any number whatsoever of radiant elements 12.

The central portions 18 are connected fluid-dynamically with each other by means of collectors 20, upper and lower.

A heating means is provided, not shown, for example of the electric resistance type, able to heat a heat-carrying fluid, such as for example a diathermic oil.

The heat-carrying fluid is made to flow in the central portions 18 and, through the collectors 20, from one radiant element 12 to the other, to heat the air in the room.

Each pair of heat-conductor plates 14 and 16 comprises lateral walls 22 which are distanced from the corresponding central portion 18 so as to define respective peripheral zones 26, for example the external peripheral edges.

The mobile device 10 also comprises heat-insulating elements 24 applied to cover a part of the peripheral zones 26 of the lateral walls 22.

In particular, the heat-insulating elements 24 are made of elastomer material, for example any thermoplastic material, or of rubber or other material having similar or comparable characteristics.

According to the embodiment shown in FIG. 1, each heat-insulating element 24 is made in a single piece as a ring, having a development substantially equal to, or slightly less than, the perimeter of the peripheral zone 26 of the lateral walls 22. The ring is advantageously elastic, so as to allow the mounting thereof in a snap-in way, by exploiting the elastic return of the material of the ring after its positioning around the perimeter of the lateral walls 22 of the plates 14 and 16.

Figure 6:
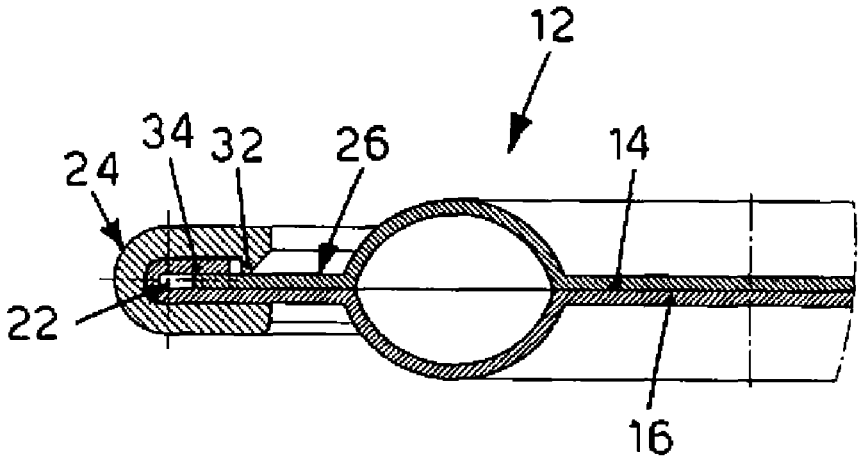
FIGS. 6 and 7 are cross-sectional views of details of two exemplary embodiments of the present invention.

As shown in FIG. 6, the elastic ring which forms the insulating element 24 may be provided at one end thereof with a tooth 32, which engages with a turned edge of the plate 16 so as to ensure a firm and stable coupling of the insulating element 24 with the lateral wall 22 of the radiant element 12.

Each heat-insulating element 24 is also shaped internally so as to have an annular groove able to couple, due to having substantially the same shape, with the peripheral zone 26 of the respective lateral walls 22.

Figure 2:
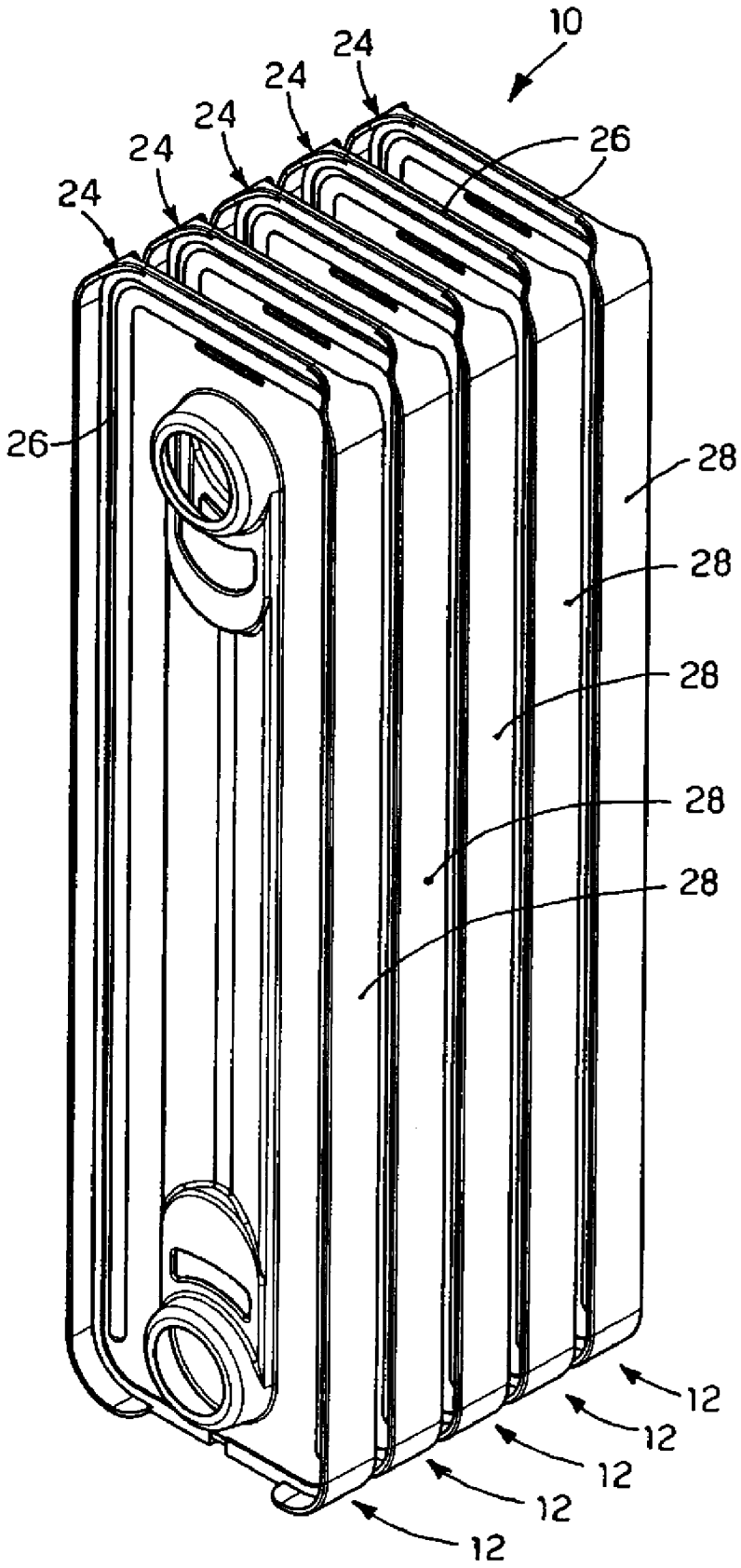
FIG. 2 is a three-dimensional view of a second form of embodiment of the mobile device in FIG. 1.

According to the solution shown in FIG. 2, the heat-insulating elements 24 comprise protection elements 28 which develop laterally along the peripheral zone 26 and partly cover the space between two adjacent peripheral zones 26.

In the solutions shown, when the heat-insulating elements 24 are applied to the peripheral zones 26, the protection elements 28 of two adjacent heat-insulating elements 24 are distanced from each other so as to define a channel through which the heated air arriving from the central portion 18 can flow.

Figure 7:
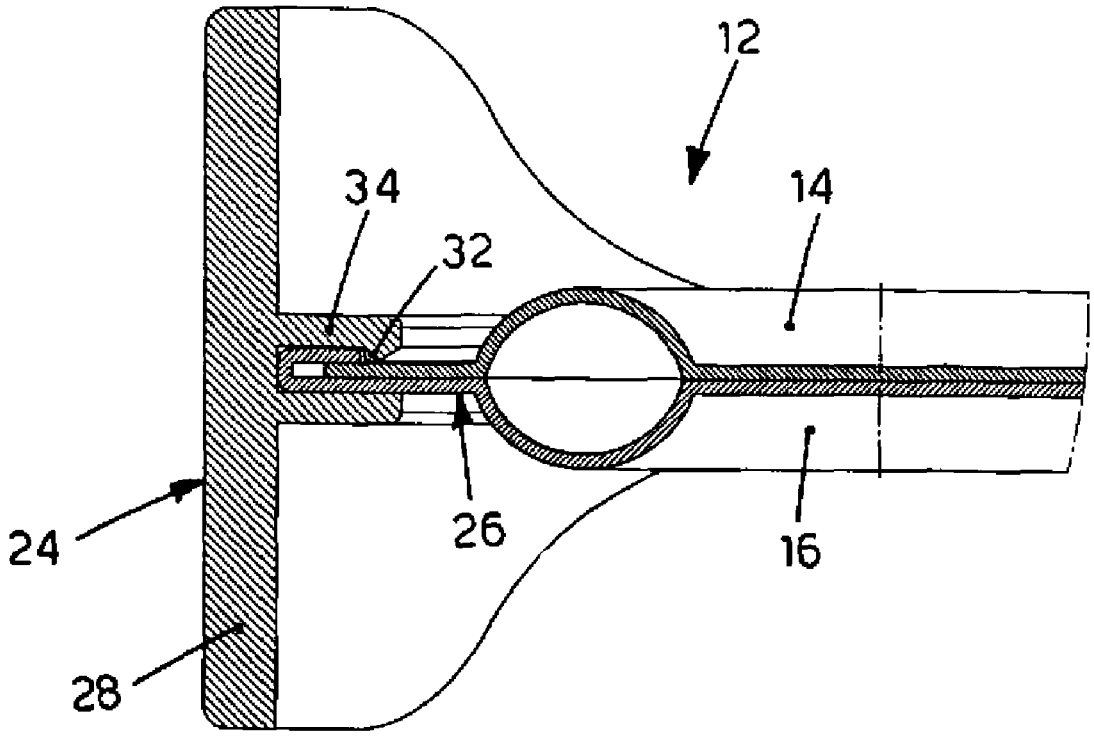

In the solution disclosed in FIG. 7, the heat-insulating element 24 comprises in a single piece the lateral protection element 28 and a central rib 34 which defines the annular grove for the coupling with the peripheral edge of the plates 14 and 16 and which comprises the tooth 32 for engaging with the turned edge of the plate 16.

Figure 3:
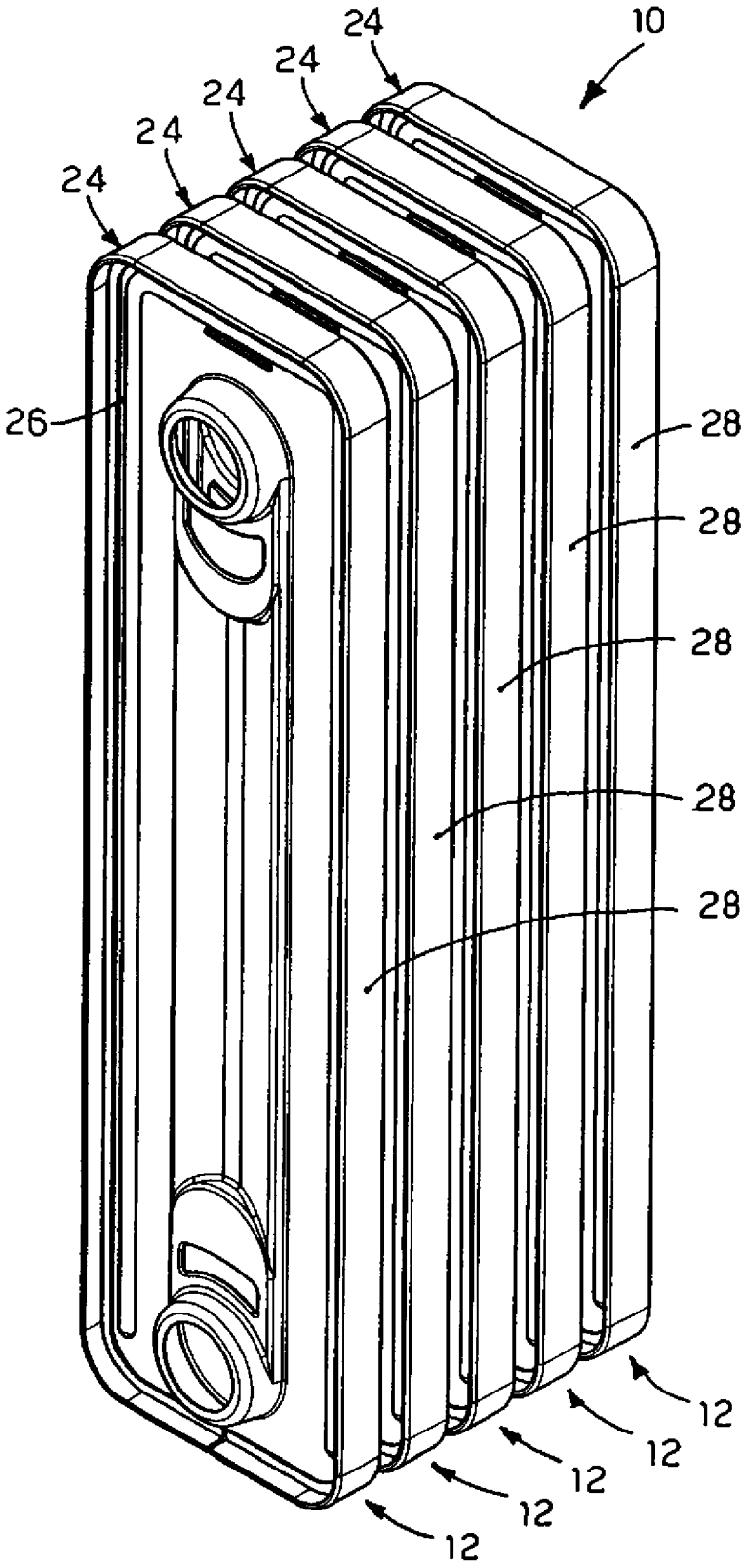
FIG. 3 is a three-dimensional view of a third form of embodiment of the mobile device in FIG. 1.

According to the solution shown in FIG. 3, the protection elements 28 completely surround in a ring the peripheral zone 26.

Figure 4:
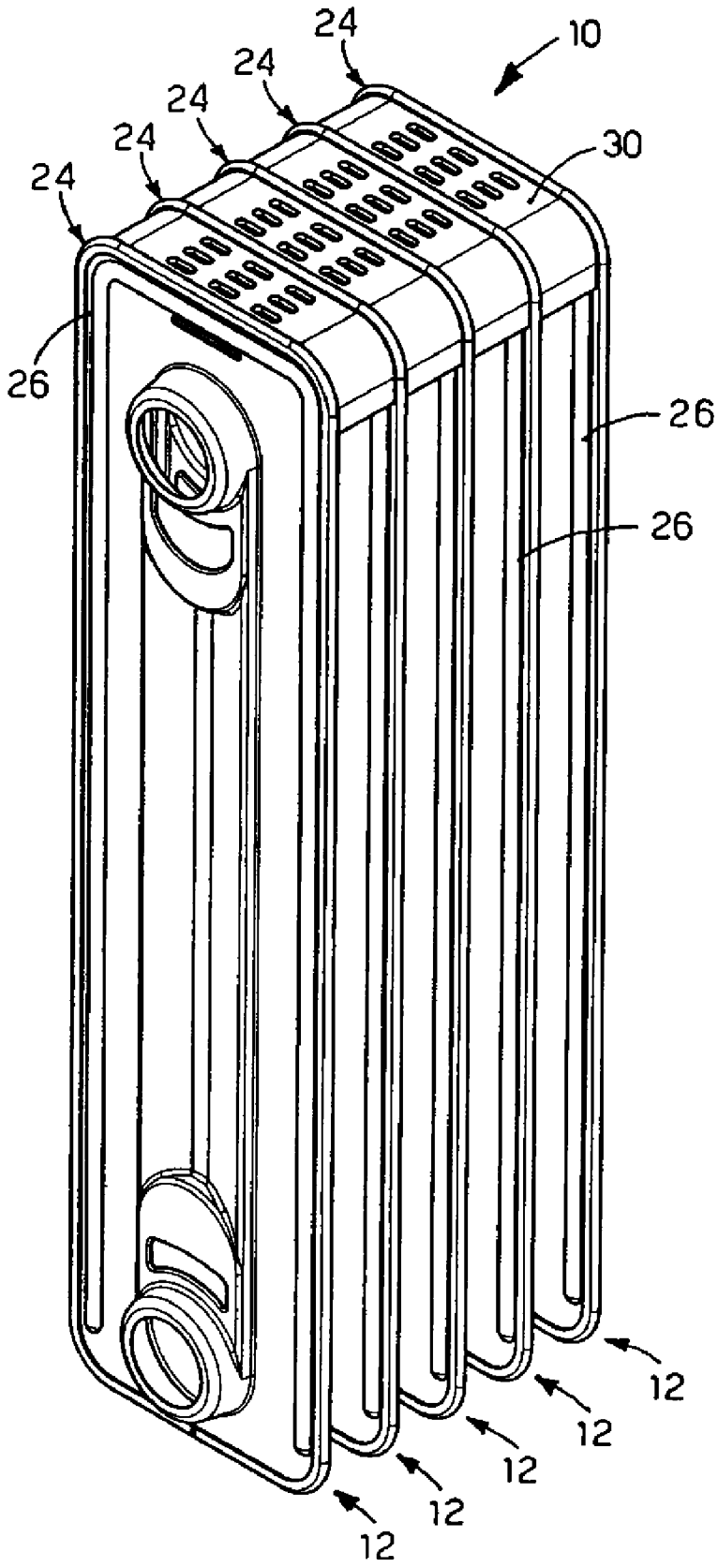
FIG. 4 is a three-dimensional view of a fourth form of embodiment of the mobile device in FIG. 1.

According to the solution shown in FIG. 4, the heat-insulating elements 24 comprise an upper cover 30 able to connect the heat-insulating elements 24 and provided with a plurality of through holes to allow the passage of the heated air arriving from the central portion 18.

Figure 5:
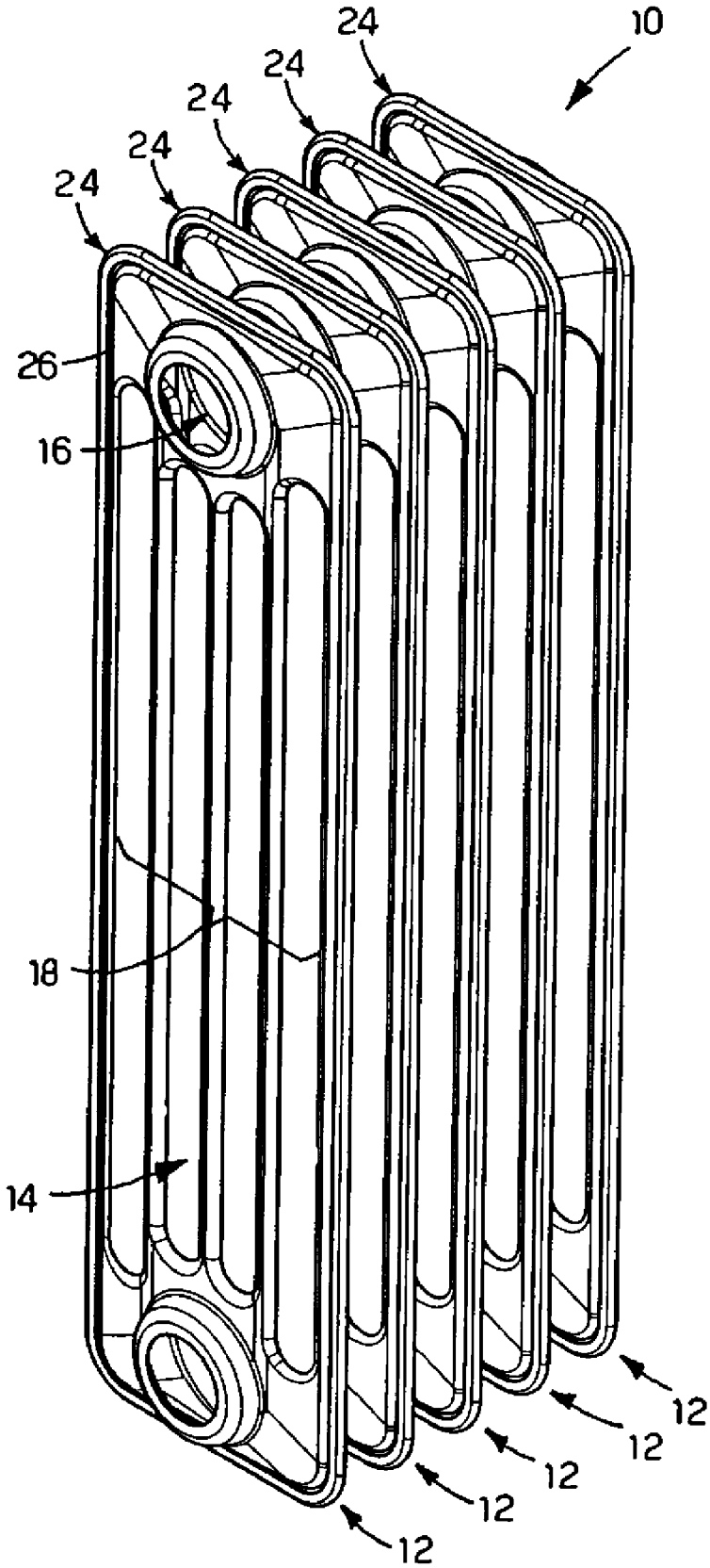
FIG. 5 is a three-dimensional view of a fifth form of embodiment of the mobile device in FIG. 1.

According to the solution shown in FIG. 5, the invention can also be applied to radiant elements 12 provided with plates 14 and 16 which define a central portion 18 which extends substantially to the peripheral zones 26.

It is clear that modifications and/or additions of parts may be made to the mobile device 10 as described heretofore, without departing from the scope of the present invention.

It is also clear that, although the present invention has been described with reference to some specific examples, a person of skill in the art shall certainly be able to achieve many other equivalent forms of mobile device for heating rooms, having the characteristics as set forth in the claims and hence all coming within the scope of protection defined thereby.

The invention claimed is:

1. A mobile device for heating rooms, comprising:

a radiant element including two heat-conductor plates associated with each other to define a central portion, the central portion connected fluid-dynamically to a fluid collector, wherein a heated heat-carrying fluid is able to flow in said central portion and through said fluid collector, from said radiant element to another radiant element for heating a surrounding room, and wherein each pair of said heat-conductor plates comprises lateral walls which are distanced from the corresponding central portion; and a heat-insulating cover made of a heat-insulating material, the heat-insulating cover being directly connected to a top and a lateral side of the two heat-conductor plates, the heat-insulating cover that is directly connected to the lateral side of the two heat-conductor plates has a side protection element at least partly covering a space near the lateral side of the two heat-conductor plates, the side protection element defining a lateral side channel for air flow heated by the central portion.

2. The mobile device as in claim 1, wherein said heat-insulating cover is made of plastic material.

3. The mobile device as in claim 1, wherein said heat-insulating cover is made of elastomer material.

4. The mobile device as in claim 1, wherein said heat-insulating cover comprises an extension that substantially reproduces the perimeter profile of said peripheral zones.

5. The mobile device as in claim 4, wherein said heat-insulating cover is shaped to be directly connected with said lateral side by a male-female coupling.

6. The mobile device as in claim 5, wherein said male-female coupling comprises a groove provided in said heat-insulating cover, the groove for inserting peripheral edges of the lateral side of the two heat-conductor plates.

7. The mobile device as in claim 5, wherein said male-female coupling comprises at least a tooth provided on an end portion of said covering element for engaging with a turned edge of one of the peripheral edges of the two heat-conductor plates.

8. The mobile device as in claim 1, wherein said heat-insulating cover is applied so as to cover at least a quantity equal to about 60-70% of the overall height of each heat-conductor plate.

9. The mobile device as in claim 1, wherein said heat-insulating cover is applied so as to also cover a lower peripheral zone of the heat-conductor plates.

10. The mobile device as in claim 1, wherein said heat-insulating cover is shaped as a ring, having a development substantially equal to or slightly less than a perimeter of the two heat-conductor plates.

11. The mobile device as in claim 1, wherein the side protection element is configured to be substantially co-planar with respect to another side protection element connected to the another radiant element.

12. The mobile device as in claim 1, wherein the side protection element is also provided at the top of the two heat-conductor plates.

13. The mobile device as in claim 1, wherein said heat-insulating cover comprises a top cover element disposed in correspondence with the top of the two heat-conductor plates.

14. A mobile device for heating rooms, comprising:

a plurality of radiant elements, each of said radiant elements including opposing heat-conductor plates associated with each other to define a central portion and lateral walls extending away from said central portion to form peripheral zones with external peripheral edges, the central portions of adjacent of said radiant elements being connected fluid-dynamically by a fluid collector, wherein a heat-carrying fluid is able to flow in said fluid collector from the central portion of one of said radiant elements to another for heating a surrounding room, said external peripheral edges having a shape; and a cover made of a heat-insulating material and directly connected to said external peripheral edges of the opposing heat-conductor plates of each of the radiant elements, said cover having an internal shape substantially the same as the shape of the external peripheral edges so as on attachment to said external peripheral edges, the attachment is a solid male and female coupling which does not require auxiliary attachment means.

* * * * *